US007250135B2

(12) United States Patent
Lim et al.

(10) Patent No.: US 7,250,135 B2
(45) Date of Patent: Jul. 31, 2007

(54) PB-FREE SOLDER ALLOY

(75) Inventors: Suk Joon Lim, Yongin (KR); Sang Wan Cho, Seoul (KR)

(73) Assignee: MK Electron Co., Ltd., Yongin (KR)

( * ) Notice: Subject to any disclaimer, the term of this patent is extended or adjusted under 35 U.S.C. 154(b) by 0 days.

(21) Appl. No.: 11/252,415

(22) Filed: Oct. 18, 2005

(65) Prior Publication Data

US 2006/0088440 A1 Apr. 27, 2006

(30) Foreign Application Priority Data

Oct. 22, 2004 (KR) ..... 10-2004-0084810

(51) Int. Cl.
*C22C 13/00* (2006.01)

(52) U.S. Cl. ..... 420/560; 420/561; 148/400

(58) Field of Classification Search ..... 148/400; 420/560, 561
See application file for complete search history.

(56) References Cited

FOREIGN PATENT DOCUMENTS

JP 2001121285 * 5/2001

* cited by examiner

*Primary Examiner*—Sikyin Ip
(74) *Attorney, Agent, or Firm*—Volpe and Koenig, P.C.

(57) ABSTRACT

Provided is a Pb-free solder alloy used for mounting electronic parts on a printed circuit board. The Pb-free solder alloy is highly resistant to oxidation and impact. The Pb-free solder alloy includes Ag of 2.8 wt % to 4.2 wt %, Cu of 0.3 wt % to 0.8 wt %, Ge of 0.0001 wt % to 0.01 wt %, In of 0.001 wt % to 0.2 wt %, and the balance of Sn. The Pb-free solder alloy having this composition also has a high shear strength and low brittleness factor after bonding. Thus, the Pb-free solder alloy has high quality mechanical properties, to form a high quality joint.

2 Claims, No Drawings

PB-FREE SOLDER ALLOY

CROSS-REFERENCE TO RELATED PATENT APPLICATION

This application claims the benefit of Korean Patent Application No. 10-2004-0084810, filed on Oct. 22, 2004, in the Korean Intellectual Property Office, the disclosure of which is incorporated herein in its entirety by reference.

BACKGROUND OF THE INVENTION

1. Field of the Invention

The present invention relates to a solder alloy used as a bonding material for mounting electronic parts on a printed circuit board (PCB), and more particularly, to a tin-silver-copper group (Sn—Ag—Cu group) solder alloy having no lead (Pb) component.

2. Description of the Related Art

Solder is used to mount electronic parts such as semiconductor chips or discrete components on a PCB. The most common solder composition is a binary alloy of Sn and Pb. However, Pb is harmful to the human body, and eventually pollutes the environment. Thus, the use of Pb in the manufacture of a solder alloy is now regulated or excluded in the electronic industry, to encourage the development of an environmentally friendly Pb-free solder alloy. A ternary Pb-free solder alloy of Sn—Ag—Cu has been suggested as the best candidate to replace the binary solder alloy of Sn—Pb.

However, the ternary Pb-free solder alloy of Sn—Ag—Cu oxidizes more easily than the binary solder alloy of Sn—Pb. Thus, an excessive amount of dross is generated, bond strength is reduced, and the flow and wetting properties are deteriorated. Also, the ternary Pb-free solder alloy of Sn—Ag—Cu is sensitive to impact, and is thus unsuitable for portable appliances such as cellular phones, digital cameras, and the like.

Thus, attempts have been made to add phosphor (P), gallium (Ga), or the like to the ternary Pb-free solder alloy of Sn—Ag—Cu, to prevent dross or oxidation. Although this successfully prevents oxidation, the resulting alloy is brittle and thus weak to impact. It is therefore difficult to use the ternary Pb-free solder alloy of Sn—Ag—Cu in portable appliances.

SUMMARY OF THE INVENTION

The present invention provides a Pb-free solder alloy of Ag of 2.8 wt % to 4.2 wt %, Cu of 0.3 wt % to 0.8 wt %, Ge of 0.0001 wt % to 0.01 wt %, indium (In) of 0.001 wt % to 0.2 wt %, and the balance of Sn.

According to an aspect of the present invention, there is provided a Pb-free solder alloy that is a quinary Pb-free solder alloy of Sn—Ag—Cu—Ge—In obtained by adding Ge and In to a ternary alloy of Sn—Ag—Cu. The Pb-free solder alloy is resistant to oxidation due to the addition of Ge and resistant to impact due to the addition of In. Also, the Pb-free solder alloy can maximize work efficiency due to its improved flow and wetting.

DETAILED DESCRIPTION OF THE INVENTION

The present invention will now be described more fully. The invention may, however, be embodied in many different forms, and should not be construed as being limited to the embodiments set forth herein; rather, these embodiments are provided so that this disclosure will be thorough and complete, and will fully convey the concept of the invention to those skilled in the art.

A Pb-free solder alloy according to the present invention includes Ag of 2.8 wt % to 4.2 wt %, Cu of 0.3 wt % to 0.8 wt %, Ge of 0.0001 wt % to 0.01 wt %, indium (In) of 0.001 wt % to 0.2 wt %, and the balance of Sn. Research by the present inventors has shown that Sn lowers the melting point of a bonding base metal, Ag increases the diffusion speed of the bonding base metal during melting, and Cu increases tensile strength. Ge grants a strong tolerance to oxidation, and In increases resistance to impact.

The Ag content of the Pb-free solder alloy according to the present invention is 2.8 wt % to 4.2 wt %. If the Pb-free solder alloy includes less than 2.8 wt % Ag, electricity and heat conductivity are inadequate. If the Pb-free solder alloy includes more than 4.2 wt % Ag, it is difficult to adjust the melting temperature. If Ag is maintained within the range between 2.8 wt % and 4.2 wt %, an addition of a small amount of Ge and In allows the Pb-free solder alloy according to the present invention to be reliably melted with a difference of 10° C. or less between the liquidus and solidus line temperatures. Thus, semiconductors and other electronic devices operate reliably due to a more gentle variation of the thermal expansion coefficient caused by thermal deformation and a difference in a heating melting temperature, and their lifespan can be extended.

The Cu content of the Pb-free solder alloy according to the present invention is within the range between 0.3 wt % and 0.8 wt %. If the Pb-free solder alloy includes less than 0.3 wt % Cu, it is difficult to obtain a suitable tensile strength. If the Pb-free solder alloy includes more than 0.8 wt % Cu, the structure of the Pb-free solder alloy becomes hard enough to be easily broken down.

The Ge content of the Pb-free solder alloy according to the present invention reduces oxidization at a high temperatures and smoothes the surface after soldering. Also, although the Pb-free solder alloy according to the present invention includes a very small amount of Cu, the melting temperature range of the Pb-free solder alloy is reduced. 0.0001 wt % or more Ge is added. The addition of less than 0.0001 wt % Ge has no effect on the Pb-free solder alloy. An increase in the amount of Ge is greatly effective in removing an oxide layer. However, after a point, additional Ge makes the solder brittle. Therefore, the amount of Ge is limited to 0.01 wt %. In other words, the addition of Ge of 0.01 wt % or more is contrary to overcoming of a weak resistance to impact that is another object of the present invention. Thus, the addition of Ge may be 0.0001 wt % to 0.01 wt %.

The In content of the Pb-free solder alloy according to the present invention softens the material and refines the grain during solidification after bonding, to improve bond strength. Thus, the In of the Pb-free solder alloy according to the present invention overcomes the weak resistance to impact of a ternary alloy of Sn—Ag—Cu. Resistance to impact is an important performance criteria for portable electronic parts such as cellular phones, notebook computers, and the like, to be suitable for all types of compact and mobile electronic parts. In the present invention, at least 0.0001 wt % In is added. Less than 0.0001 wt % In has no effect on the Pb-free solder alloy. However, In is expensive, and an addition of more than 0.2 wt % in does not give a great effect. Thus, the addition of In is limited to 0.2 wt % or less. Thus, the addition of In may be 0.0001 wt % to 0.2 wt %.

Balls of alloy (hereinafter referred to as solder balls) each having a diameter of 0.76 mm were manufactured from the Pb-free solder alloy according to the present invention and an existing ternary alloy of Sn—Ag—Cu. The experimental results of these solder balls will now be described in detail. However, the follow experimental example is provided only to more easily understand the present invention, and not to limit the present invention.

According to the present invention, a Pb-free solder alloy including Ag of 4.0 wt %, Cu of 0.5 wt %, Ge of 0.005 wt %, In of 0.1 wt %, and the balance of Sn was made into a solder ball. For the comparison, a ternary alloy solder ball including Ag of 4.0 wt %, Cu of 0.5 wt %, and the balance of Sn was manufactured. Table 1 below shows the thicknesses of oxide layers, shear strengths and brittleness factors of the solder balls after they were bonded to a PCB.

TABLE 1

| | Composition | Thickness of Oxide Layer | Shear Strength After Bonding | Brittleness Factors After Bonding |
|---|---|---|---|---|
| Present Invention | Ag of 4.0 wt %, Cu of 0.5 wt %, Ge of 0.005 wt %, %, In of 0.1 wt, balance Sn | 52 nm | 2245 g | 0.00 |
| Comparison Example | Ag of 4.0 wt %, Cu of 0.5 wt %, balance Sn | 405 nm | 2052 g | 0.14 |

To perform bonding, a water-soluble flux was coated on the PCB, and the solder balls were put on the PCB and then heated to 245° C. for 40 seconds in a reflow furnace. The thicknesses of the oxide layers were obtained by measuring oxide layers generated after the solder balls were bonded and heated 10 times under the above bonding conditions using Auger Electron Spectroscopy. There is no method of evaluating resistance to impact. Thus, the shear strength and brittleness factor were measured after bonding so as the resistance to impact to be indirectly evaluated. The brittleness factor was calculated through the ratio of soft fractures to brittle fractures observed after testing the shear stress. In other words, when the brittleness factor is large, the interface of a solder joint is brittle. A high shear strength and low brittleness factor combine to give a high resistance to impact.

As shown in Table 1, in the case of the solder ball made of the Pb-free solder alloy according to the present invention, the oxide layer is thinner than in the comparison example. Therefore, the Pb-free solder alloy according to the present invention is resistant to oxidation. Thus, an excessive amount of dross is not generated. As a result, the bond strength is improved.

Also, the solder ball made of the Pb-free solder alloy according to the present invention has a high shear strength but a low brittleness factor after bonding. In other words, the resistance to impact is great.

As described above, a quinary Pb-free solder alloy of Sn—Ag—Cu—Ge—In according to the present invention has a very high resistance to oxidation during exposure to an oxidizing environment at a high temperature, compared to the conventional ternary Pb-free solder alloy of Sn—Ag—Cu. After bonding, the shear strength is high and the brittleness factor is low. Thus, the quinary Pb-free solder alloy of Sn—Ag—Cu—Ge—In has good mechanical properties and thus a great resistance to impact. Accordingly, if a Pb-free solder alloy according to the present invention is used, a high quality joint can be formed when mounting electronic products. Flow and wetting are improved, to inhibit a thread-shaped bridge from forming. Also, a short defect can be greatly reduced, and work efficiency can be improved.

While the present invention has been particularly shown and described with reference to exemplary embodiments thereof, it will be understood by those of ordinary skill in the art that various changes in form and detail may be made therein without departing from the spirit and scope of the present invention as defined by the following claims.

What is claimed is:

1. A Pb-free solder alloy consisting of Ag of 2.8 wt % to 4.2 wt %, Cu of 0.3 wt % to 0.8 wt %, Ge of 0.0001 wt % to 0.01 wt %, In of 0.001 wt % to 0.2 wt %, and the balance of Sn.

2. The Pb-free solder alloy of claim 1, wherein the Sn content is at least 94.79 wt %.

* * * * *